United States Patent [19]

Goloff

[11] 4,273,178

[45] Jun. 16, 1981

[54] VIBRATOR CASTING SYSTEM WITH FEEDBACK

[75] Inventor: Alexander Goloff, East Peoria, Ill.

[73] Assignee: Caterpillar Tractor Co., Peoria, Ill.

[21] Appl. No.: 55,588

[22] Filed: Jul. 9, 1979

[51] Int. Cl.[3] ..... B22D 2/00; B22D 46/00

[52] U.S. Cl. ..... 164/4; 164/154; 164/49; 367/95; 367/908

[58] Field of Search ..... 164/4, 154, 155, 150, 164/49; 324/204, 236; 331/46, 65; 367/95, 908, 190, 65, 41

[56] References Cited

U.S. PATENT DOCUMENTS

| | | | |
|---|---|---|---|
| 2,753,542 | 7/1956 | Rod et al. | 367/908 |
| 3,079,596 | 2/1963 | Atkinson | 367/908 |
| 3,115,615 | 12/1963 | Saper | 367/908 |
| 3,985,030 | 10/1976 | Charlton | 367/95 |
| 4,000,650 | 1/1977 | Snyder | 367/95 |

FOREIGN PATENT DOCUMENTS

| | | | |
|---|---|---|---|
| 813497 | 5/1959 | United Kingdom | 367/908 |

*Primary Examiner*—Robert D. Baldwin
*Assistant Examiner*—K. Y. Lin
*Attorney, Agent, or Firm*—Phillips, Moore, Weissenberger, Lempio & Majestic

[57] ABSTRACT

Flow of viscous molten metal (12) to thin sections (48) of mold cavities (14) is difficult to attain thus resulting in inferior molded products. This problem is solved herein by generating waves (20) in the molten metal (12), sensing the waves (20) in the molten metal (12) at a thin section (48) of the mold cavity (14) spaced from the generating position of the waves (20), and controlling the generating responsive to the waves (20) sensed. Basically, a control circuit (56) increases the amplitude, and/or changes the frequency, of the waves (20) generated, if the waves (20) sensed are not sufficiently strong. The invention is useful for flowing other liquids besides molten metal in other cavities than in molds, although this is its prime contemplated use.

16 Claims, 1 Drawing Figure

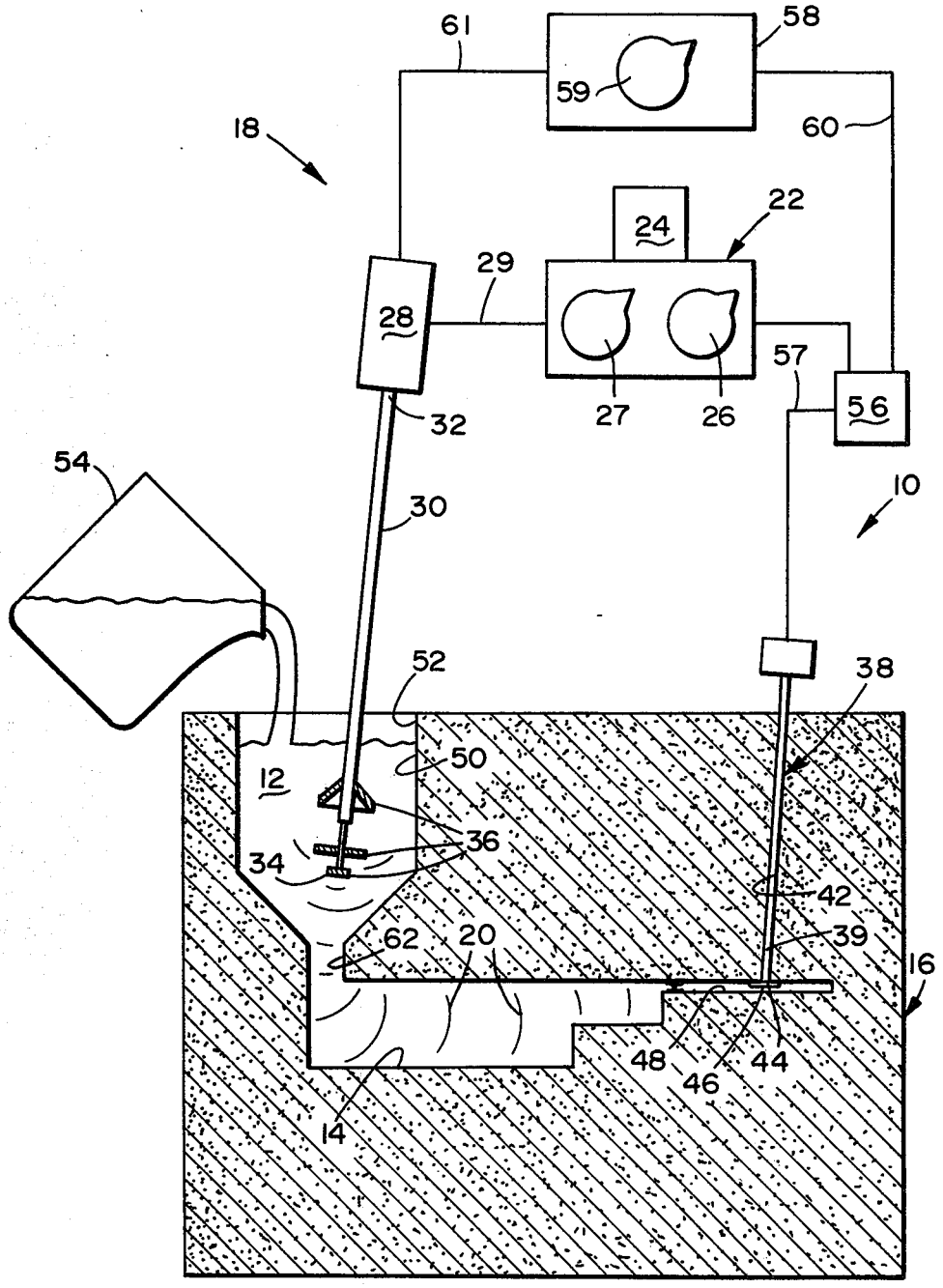
61
58
59
60
18
22
24
29
28
27
26
57
56
32
54
30
10
52
38
50
12
36
34
42
39
62
20
16
48
46
44
14

VIBRATOR CASTING SYSTEM WITH FEEDBACK

DESCRIPTION

1. Technical Field

The invention relates to a method and apparatus for aiding the flow of a somewhat viscous liquid in a cavity to improve the filling thereof. Such apparatus and method find particular utility in accomplishing full filling of the cavity of a mold with molten metal in the production of cast metal parts.

2. Background Art

Various types of cavities are filled by pouring viscous liquids into them. When the cavities have relatively thin sections, i.e., sections which have a generally small cross-section generally orthogonal to the flow thereat, a serious problem exists in obtaining full filling of these thin sections with the liquid. Such problems are especially troublesome in the casting of molten metals to form metallic parts.

A number of methods are known to obtain adequate filling of thin sections of molds. It is known to heat the mold, for example a cermamic mold, to about 1,000° C. or higher prior to pouring a molten metal such as steel thereinto. This prevents premature solidification or even premature increases in viscosity as the molten metal cools towards the solidification temperature thereof. Thus, good filling of the mold is accomplished. Such molds are, however, quite expensive because of the material involved. Further, the energy used to heat the molds to these high temperatures is not normally recoverable.

As an alternative, the composition of the molten metal can be adjusted to provide better filling of thin sections. For example, so called grey iron fills cavities more readily than steel because of its greater fluidity. If particularly thin sections are needed, phosphorus may be added to the metal composition. This is useful in making ornamental castings wherein the particular properties of the final cast product are not critical, but, the product resulting from the use of grey iron is relatively brittle and is not readily usable for many parts used as portions of machines since it does not have the required physical properties therefor.

As another alternative, the casting can be made under pressure as by die casting. This is, however, not readily adaptable to steel casting, because of the high mold cost involved due to the high temperatures of steel casting. Such molds must also be quite strong to retain the pressure. Thus, while steel or iron under pressure will fill narrow passages, such can be accomplished only at relatively great expense.

When pipes or other bodies of revolution are desired a centrifugal casting technique can be utilized. This is basically a variation of casting the desired product under pressure and eliminates the need for containing molten iron on the internal diameter of the pipe being cast. However, such a technique is not useful for other than bodies of revolution. Further, such a technique requires relatively heavy duty equipment to provide the necessary centrifugal force.

A further technique for attaining adequate casting in thin sections is by making use of very accurate core placement through use of very accurate molding techniques as with the making of automotive grey iron engine blocks. While this doesn't accomplish any better filling of the thin sections, it does control the minimum cross flow dimension and this minimum cross flow dimension can be set at a minimum size at which adequate flow will still occur. For example, if adequate flow will occur in thin sections having a cross dimension of 3 mm (milimeter) but will not occur if the cross dimension is less than 3 mm, then a mold can be constructed with a very accurately controlled minimum cross dimension of 3 mm. Both the metallurgy and the pouring techniques must be carefully controlled and the capital investment in making such molds is extremely high.

Entire molds have also been shaken to try to get the fluid therein to fill thin sections. Further, in pouring concrete, vibrators have been used to induce better mold filling.

It should be noted that the aforementioned prior art techniques do not provide a careful control of the degree of filling of thin sections, or even any absolute certainty that the thin sections have been filled until the part made in the mold is released therefrom and examined. Further, it should be noted that relatively large capital expenditure and/or energy use characterizes at least most of the prior art techniques. Further, those prior art techniques which are relatively inexpensive require the use of easy flowing metals and do not have the versatility of being usable with less easy flowing metals.

DISCLOSURE OF INVENTION

The present invention is directed to overcoming one or more of the problems as set forth above.

In one aspect of invention, a method is provided for filling a cavity with a liquid. The method comprises introducing the liquid into the cavity, generating a plurality of waves in the fluid at a first position therein, sensing the waves at a second position spaced from the first position, and controlling the generating of the waves in response to the waves sensed.

In another aspect of invention, an apparatus is provided which includes means for carrying out the method set out above.

A problem exists in fully filling cavities, including thin sections of molds, in a relatively inexpensive manner without making a large capital investment and without the need for increasing fluidity by charging the chemistry of the liquid being cast within the mold or other cavity. This problem is solved herein by generating a plurality of vibratory pressure waves within the liquid filling the cavity and sensing the waves at a thin section of the cavity. A feedback network responds to the sensed signal and increases the amount of vibrational energy being put into the pressure waves (amplitude) and/or changes the frequency range of the vibrational energy, if the sensor is not receiving enough signal to indicate that full filling of the mold is being accomplished. The pressure waves serve to push the viscous liquid into the thin sections and, for that matter, into all portions of the mold cavity. And, all of this is accomplished with a relatively small capital expenditure and with a relatively small expenditure of energy, yet while retaining the ability to operate with substantially any reasonably flowable liquid.

BRIEF DESCRIPTION OF DRAWING

The sole FIGURE of the drawing is a schematic view of an embodiment of the present invention.

BEST MODE OF CARRYING OUT THE INVENTION

Adverting to the FIGURE, there is illustrated therein an apparatus 10 for aiding the flow of a viscous liquid 12 in a cavity 14, such as a mold 16. Such molds can be made by conventional sand casting techniques and are well known in the casting art. The apparatus 10 serves to improve the filling of the cavity 14.

Means 18 serve for generating pressure waves, indicated by lines 20, in the as yet unsolidified liquid 12 as it is poured into the cavity 14. The pressure generating means 18 in the embodiment illustrated comprises an oscillator 22. The generating means 18 also normally includes means 24 (in the embodiment illustrated a simple sweep frequency circuit which forms a part of the oscillator 22) for varying the frequency of the pressure waves 20 generated by the oscillator 22. A control knob 26 can also form a portion of the generating means 18. The knob 26 serves for manual adjustment of the frequency of the pressure waves 20 being generated. This is desirable since some frequencies are more effective than others in filling the cavity 14, dependent upon the geometry thereof. Similarly, an amplitude control knob 27 provides for manual adjustment of the amplitude of the pressure waves 20. The generating means 18 further includes a vibrator 28 excited by the oscillator 22 illustrated as being connected thereto by a line 29, with the oscillator 22 and vibrator 28 generally being located external of the cavity 14.

A coupler arm 30 is attached at a first end 32 thereof to the vibrator 28. A second end 34 of the coupler arm 30 extends into the cavity 14, and more particularly into the fluid 12. Generally there will be at least one member 36 mounted to extend laterally from adjacent the second end 34 of the coupler arm 30 to transmit vibratory energy from the vibrator 28 into the fluid 12 thus producing the pressure wave 20. In the preferred embodiment shown, a plurality of members 36 will be present to provide proper coupling of oscillation at various frequencies to the fluid 12. The members 36 will generally be in the form of washers which may be flat or conical in shape, with the conical shape being somewhat preferred to provide better coupling over a somewhat wider frequency range. The uppermost of the two washers which serve as the members 36 shown in the FIGURE is of the conical variety. By providing members 36 with diameters of varying extends, a relatively larger range of frequencies can be properly coupled from the vibrator 28 to the fluid 12. The coupler arm 30 and the members 36 are generally made of a material that has an exterior surface which is resistant to reaction with the fluid 12 in the cavity 14 to prevent any changes in composition of the fluid 12 and to prevent any possible damage to the coupler arm 30 or to the members 36. Of course, the coupler arm 30 and the members 36 must not melt at the temperature of the liquid 12.

While a rather specific vibrator 28-coupler arm 30 arrangement has been described, any means for providing the pressure waves 12 will suffice.

Sensing means 38, which serve for sensing pressure waves 20 in the liquid 12 in the cavity 14, also form an important part of the invention. Generally the sensing means 38 can comprise a conventional pressure transducer probe 39 which serves for sensing the pressure wave 20 within the cavity 14 at a position significantly spaced apart from the second end 34 of the coupler arm 30, and preferably at a relatively narrow or the narrowest or most constricted portion of cavity 14.

The generating means 18 and the sensing means 38 are spaced apart from one another as shown in the drawing. A bore 42 in the mold 16 positions the sensing means 38, and a sensing end 44 thereof, in contact with a stud chaplet 46 placed during construction of the mold in a first (constricted or thin) portion or location 48 of the cavity 14. The first portion 48 of the cavity 14 has a first cross-section generally orthogonal to flow thereat which is smaller than a second cross-section generally orthogonal to flow thereat positioned in a second portion or location 50 of the cavity 14. The second end 34 of generating means 18 is located at the second portion 50 of the cavity 14. The second portion 50 has a second cross-section generally orthogonal to flow thereat having a minimum dimension which is significantly greater than the minimum dimension of the first cross-section. The pressure waves 20 are, thus, formed in the bulk of the fluid at second portion 50 and detected or sensed at first (constricted) portion 48 where flow is severely restricted.

It is noted that the end 34 of the coupler arm 30 will normally enter a mouth portion 52 of the cavity 14 with that mouth portion 52 being the same portion whereat metal or another fluid 12 is added as via a ladle 54 to the cavity 14.

Means 56 serves to control the generating means 18 in response to the pressure waves 20 as they are sensed by the sensing means 38. The controlling means 56 (shown schematically) simply comprises a feedback loop (circuit) which receives the electrical signal from the sensing means (pressure transducer) 38 through a line 57. If the signal detected by the pressure transducer 38 is too weak, responsive to that signal, the feedback loop directs increasing of the amplitude and/or changing of the frequency generated by the oscillator 22. The increased energy and/or changed frequency is then fed into the vibrator 28 and from there into the fluid 12. The result is more complete filling of the first (constricted) section 48 of the cavity 14. The entire feedback loop consists of state-of-the-art circuitry which is readily available.

The generating means 18 may include, in the preferred embodiments of the invention, an additional oscillator 58 which may be made of adjustable frequency, if desired, as controlled by a control knob 59. In such a situation, the oscillator 58 may oscillate to produce a lower frequency portion of the pressure waves 20 while the oscillator 22 serves to generate a higher frequency portion of the pressure waves 20. The feedback circuit 56 in this embodiment is set to detect the amplitude of, for example, the higher frequency signal, namely the signal produced by the oscillator 22, and this higher frequency signal is then used only as an indicator of the degree of filling of the first portion 48 of the cavity 12. Meanwhile, the controlling means 56 controls the amplitude of the signal being generated by the lower frequency oscillator 58, through a line 60 rather than controlling the oscillator 22. If the signal picked up at the higher frequency by the pressure transducer 38 is too weak, the lower amplitude of the output of the lower frequency oscillator 58 is increased and if the higher frequency signal being detected by the pressure transducer 38 is too strong, the output is decreased to save energy. The signal generated by the oscillator 58 is delivered to the vibrator 28 through a line 61.

Even though the energy being generated at the higher frequency is not increased, the signal detected by the sensing means 38 increases as more complete filling of the cavity occurs. Of course, more thorough or complete filling results from an increased energy output at the lower frequency. Increased signal detection at sensing means 38 occurs since the liquid medium is more uniform and continuous with more complete filling and the pressure waves 20 can be more efficiently transmitted. In any event, whether a single oscillator 22 is utilized, or both the oscillator 22 and the additional oscillator 58 are utilized, the controlling means 56 will normally control the amplitude of the pressure waves 20 generated by the generating means 18. If desired, the controlling means 56 can also be set up to control the frequency generated by the generating means 18. Since the efficiency of filling of the cavity 14 varies with frequency at constant energy output, the most effective frequency range for a particular cavity 14 is determined by the geometric shape and size thereof.

Only very general guidance may be given as to necessary amplitudes and frequencies, since these vary greatly with mold geometry, fill fluid, temperature of the fluid and the like. Generally, the pressure waves 20 should be of a frequency within a range from about 20 Hz to about 10 kHz and should have an amplitude (energy) from about 50 W to about 10 KW.

INDUSTRIAL APPLICABILITY

In practicing the invention in accordance with the preferred embodiment thereof, namely wherein the cavity 14 is being filled with a molten metal and the mold 16 serves for producing cast metal parts on cooling of the metal, the metal is added from the pouring ladle 54 to the cavity 14 at the mouth 52 thereof while energy is being fed from oscillator 22 (or oscillators 22 and 58) via the vibrator 28 and the coupler arm 30 to the fluid 12 held within the cavity 14. This generates pressure waves 20 within the cavity 14 during the filling operation. Meanwhile, a pressure signal is being picked up by the sensing means 38. The signal strength is a function of the energy of the waves 20 which enter the first portion 48 (a thin section portion) of the cavity 14 which, in turn, is a function of the energy input at vibrator 28, and coupler arm 30; the composition of the fluid 12; the shape of cavity 14; and the extent to which voids are absent as the fluid 12 fills cavity 14. The amplitude of the signal is transmitted via the controlling means 56 and serves to control the generating means 18 to increase the amplitude of the pressure waves 20 if not enough energy is reaching the sensing means 38. Once an adequate filling of the cavity 14 has been obtained (at least up to a gate portion 62 thereof), the signal at the sensing means 38 increases, and then the generating means 18 is turned off and the coupler arm 30 is removed. The fluid 12 is then allowed to cool and solidify and the resulting cast part is removed from the mold in a conventional manner.

Other aspects, objectives, and advantages of this invention can be obtained from a study of the drawings, the disclosure and the appended claims.

What is claimed is:

1. An apparatus (10) for aiding the flow of a liquid (12) in a cavity (14) to improve the filling thereof, comprising:

means (18) for generating a plurality of waves (20) in the liquid (12) in the cavity (14) at a first location (50);

means (38) for sensing the waves (20) at a second location (48) spaced from the first location (50), said first location (48) of said cavity (14) defining a first cross-section generally orthogonal to flow thereat and said second location (50) of said cavity (14) defining a second cross-section generally orthogonal to flow thereat, a minimum dimension of said first cross-section being significantly smaller than a minimum dimension of said second cross-section; and means (56) for controlling said generating means (18) in response to the waves (20) sensed by said sensing means (38).

2. An apparatus (10) for aiding the flow of a liquid (12) in a cavity (14) to improve the filling thereof, comprising:

means (18) for generating a plurality of waves (20) in the liquid (12) in the cavity (14) at a first location (50), said generating means (18) including a vibrator (28), a coupler arm (30) attached at a first end (32) thereof to said vibrator (28) and with a second end (34) thereof in said cavity (14) and at least one member (36) mounted to extend laterally from the second end (34) of said coupler arm (30);

means (38) for sensing the waves (20) at a second location spaced from the first location (50); and means (56) for controlling said generating means (18) in response to the waves (20) sensed by said sensing means (38).

3. An apparatus as in claim 1, wherein said controlling means (56) controls the amplitude of the waves (20) generated by the generating means (18).

4. An apparatus as in claim 1, wherein said generating means (18) has means (24) for varying the frequency of the waves (20) generated thereby.

5. An apparatus as in claim 2, wherein there are a plurality of said members (36) which extend different distances laterally.

6. An apparatus as in claim 2, wherein said second end (34) of said coupler arm (30) and said member (36) each have an exterior surface which is resistant to reaction with the liquid (12) in the cavity (14).

7. An apparatus (10) for aiding the flow of a liquid (12) in a cavity (14) to improve the filling thereof, comprising:

means (18) for generating a plurality of waves (20) in the liquid (12) in the cavity (14) at a first location (50), said generating means (18) generating a plurality of wave frequencies;

means (38) for sensing the waves (20) at a second location (48) spaced from the first location (50), said sensing means (38) sensing a relatively high frequency portion of said wave frequencies (20); and means (56) for controlling said generating means (18) in response to the waves (20) sensed by said sensing means (38), said controlling means (56) controlling the amplitude of a relatively low frequency portion of the wave frequencies generated by said generating means (18).

8. An apparatus (10) for aiding the flow of a liquid (12) in a cavity (14) to improve the filling thereof, comprising:

means (18) for generating a plurality of waves (20) in the liquid (12) in the cavity (14) at a first location (50), said generating means (18) including a first generator (22) generating a relatively high frequency signal and a second generator (58) generating a relatively low frequency signal;

means (38) for sensing the waves (20) at a second location spaced from the first location (50), said sensing means (38) sensing a frequency generated by said first generator (22);

means (56) for controlling said generating means (18) in response to the waves (20) sensed by said sensing means (38), said controlling means (56) controlling said second generator (58).

9. An apparatus as in claim 1, wherein said liquid (12) is a molten metal and said cavity (14) is in a mold (16).

10. A method for filling a cavity (14) with a liquid (12), comprising:

introducing the liquid (12) into the cavity (14);

generating waves (20) in the liquid (12) at a first position (50) in the cavity (14);

sensing the waves (20) in the liquid (12) at a second position (48) in the cavity (14), the second position (48) being spaced apart from the first position (50), said second position (48) being selected such that a minimum dimension of a cross-section generally orthogonal to flow thereat at said cavity (14) at said first position (50) is significantly larger than a minimum dimension of a cross-section generally orthogonal to flow thereat at said cavity (14) at said second position (48); and controlling the generating of the waves (20) responsive to the waves (20) sensed.

11. A method for filling a cavity (14) with a liquid (12), comprising:

introducing a liquid (12) into the cavity (14);

generating waves (20) in the liquid (12) at a first position (50) in the cavity (14), said generating step separately generating a relatively lower frequency portion of said waves (20) and a relatively higher frequency portion thereof;

sensing the waves (20) in the liquid (12) at a second position (48) in the cavity (14), the second position (48) being spaced apart from the first position (50), said sensing step sensing the amplitude of said higher frequency portion of said waves (20); and controlling the generating of the waves (20) responsive to the waves (20) sensed, said controlling step controlling the generating of said lower frequency portion of said waves (20).

12. A method as in claim 15 wherein:

producing an oscillating signal; and conducting said signal via a coupler arm (30) to said first position (50) in said cavity (14) to generate said waves (20) in the liquid (12) at said first position (50) in the cavity (14).

13. A method as in claim 10, wherein said liquid (12) is a molten metal and said cavity (14) is in a mold (16).

14. A method as in claim 10, wherein said sensing step senses the amplitude of at least one frequency of the waves (20).

15. A method as in claim 10, wherein said controlling step controls the amplitude of the waves (20) generated in the generating step.

16. A method as in claim 10, wherein the generating step includes:

varying the frequency of the waves (20).

* * * * *